US009296584B2

(12) United States Patent
Banai et al.

(10) Patent No.: US 9,296,584 B2
(45) Date of Patent: Mar. 29, 2016

(54) TRANSLATABLE ROLLER MEDIA ALIGNING MECHANISM

(71) Applicant: Lexmark International, Inc., Lexington, KY (US)

(72) Inventors: Margarito Panal Banai, Tunghaan Minglanilla (PH); Jose Jonna Tohay Chavez, Daanbantayan (PH); Joseph Garces Cornelia, Mandaue (PH); Al Salcedo Pineda, Lapu-lapu (PH); Julio Tagaro Plariza, Cebu (PH); Malyn Vidal Pumariga, Quezon (PH)

(73) Assignee: Lexmark International, Inc.KY (US)

( * ) Notice: Subject to any disclaimer, the term of this patent is extended or adjusted under 35 U.S.C. 154(b) by 45 days.

(21) Appl. No.: 13/724,490

(22) Filed: Dec. 21, 2012

(65) Prior Publication Data

US 2014/0175730 A1 Jun. 26, 2014

(51) Int. Cl.

| | |
|---|---|
| ***B65H 29/12*** | (2006.01) |
| ***B65H 5/06*** | (2006.01) |
| ***B65H 7/02*** | (2006.01) |
| ***B65H 9/10*** | (2006.01) |

(52) U.S. Cl.

CPC ..... *B65H 29/125* (2013.01); *B65H 5/062* (2013.01); *B65H 7/02* (2013.01); *B65H 9/106* (2013.01); *B65H 2403/41* (2013.01); *B65H 2403/512* (2013.01); *B65H 2404/1431* (2013.01); *B65H 2404/1523* (2013.01); *B65H 2511/20* (2013.01); *B65H 2513/41* (2013.01); *B65H 2701/1311* (2013.01); *B65H 2701/1313* (2013.01); *B65H 2701/1315* (2013.01); *B65H 2801/06* (2013.01)

(58) Field of Classification Search

CPC ..... B65H 9/20; B65H 9/103; B65H 9/106
USPC ..... 271/257, 252, 227, 228
See application file for complete search history.

(56) References Cited

U.S. PATENT DOCUMENTS

| | | | | |
|---|---|---|---|---|
| 4,335,954 | A | 6/1982 | Phelps | |
| 4,823,159 | A | 4/1989 | Yamamoto et al. | |
| 5,513,839 | A * | 5/1996 | Green | 270/58.07 |
| 6,019,365 | A * | 2/2000 | Matsumura | 271/227 |
| 6,059,285 | A * | 5/2000 | Suga et al. | 271/228 |
| 6,135,446 | A * | 10/2000 | Thiemann et al. | 271/228 |
| 6,533,268 | B2 | 3/2003 | Williams et al. | |
| 7,665,730 | B2 * | 2/2010 | Funada | 271/250 |
| 7,837,193 | B2 * | 11/2010 | Mandel et al. | 271/249 |
| 8,033,544 | B2 | 10/2011 | Dondiego et al. | |
| 8,066,279 | B2 * | 11/2011 | Ishikawa et al. | 271/228 |
| 8,328,188 | B2 * | 12/2012 | Mandel et al. | 271/228 |
| 8,567,775 | B2 * | 10/2013 | Banal et al. | 271/252 |
| 2005/0012263 | A1 * | 1/2005 | Koyanagi et al. | 271/227 |
| 2006/0208416 | A1 * | 9/2006 | Dejong et al. | 271/228 |
| 2008/0054553 | A1 | 3/2008 | Muneyasu et al. | |
| 2008/0094670 | A1 * | 4/2008 | Kim | 358/474 |
| 2008/0309006 | A1 | 12/2008 | Iguchi et al. | |
| 2009/0033028 | A1 | 2/2009 | Yahata et al. | |
| 2013/0082441 | A1 * | 4/2013 | Banal et al. | 271/252 |

* cited by examiner

*Primary Examiner* — Jeremy R Severson

(57) ABSTRACT

A media conveying system for aligning a media sheet in a media path of an image forming apparatus may include a first roll mounted across the media path, a second roll mounted relative to the first roll so as to define a first nip between the first roll and the second roll, and a reference edge positioned along a side of the media path. A drive mechanism is coupled to the second roll for translating the second roll in a first direction such that a media sheet positioned in the nip moves in the first direction towards the reference edge.

19 Claims, 12 Drawing Sheets

TRANSLATABLE ROLLER MEDIA ALIGNING MECHANISM

CROSS REFERENCE TO RELATED APPLICATION

Pursuant to 37 C.F.R. §1.78, this application is a divisional application and claims the benefit of the earlier filing date of application Ser. No. 13/250,650, filed Sep. 30, 2011, entitled "Translatable Roller Media Aligning Mechanism," the contents of which are hereby incorporated by reference herein in their entirety.

BACKGROUND

1. Field of the Invention

The present application is directed to alignment systems in an image forming apparatus and particularly to systems that move a media sheet against a reference edge as the media sheet moves along a media path.

2. Description of the Related Art

Image forming apparatuses include a media path for moving media sheets from an input area, through a transfer area, and ultimately to an output area that is usually on an exterior of the apparatus. The media path may also include one or more nips formed between opposing rolls through which media sheets pass. The nips may function to drive the media sheets along the media path and/or to align the media sheets.

The media sheets should move along the media path in a consistent fashion. This is necessary to ensure the media sheets are located at the transfer area at the precise time to receive the images. The media sheets should also be aligned by the time they reach the transfer area. Proper alignment ensures the images are positioned at the correct location on the media sheets. A misaligned media sheet at the transfer area may result in a print defect as the image is not centered or otherwise located on the media sheet as desired.

In an image forming apparatus such as a multi-function printer, a post-processing device (finisher) is provided next to a paper discharge unit in the image forming apparatus body in order to carry out post-processing, such as hole punching and stapling, to a sheet on which an image has been formed.

In such a post-processing device, a sheet discharged from the image forming apparatus body may be aligned to a left or a right reference edge, or may be center-fed such that there may be a need to re-align the sheet discharged from the image forming apparatus depending on the location of the post-processing device (i.e. left to right, right to left, center-fed to right, center-fed to left). The amount of shift needed and the distance of travel before the media sheet reaches the post-processing device may pose challenges to the compactness of the design of the multi-function printer. Further, a sheet discharged from the image forming apparatus body may be skewed with respect to the media feed direction such that correction is necessary.

Therefore, there is a need to provide a media aligning mechanism to re-align and correct the skew of a media sheet discharged or to be discharged from an image forming apparatus body to effectively carry out a post-processing operation.

SUMMARY OF THE INVENTION

The present application is directed to alignment systems in an image forming apparatus. In one embodiment, the system may include a media path having a starting location and an ending location and a reference edge positioned along a side of the media path. The media moves in the media path in a media feed direction. A first roll is mounted across the media path and a second roll is mounted relative to the first roll so as to define a first nip between the first roll and the second roll. One of the first and second rolls is a driven roll for rotating the rolls about their respective rotational axes. In one embodiment, the second roll has a length shorter than the length of the first roll. A drive mechanism is coupled to the second roll for translating the second roll in a first direction other than the media feed direction such that a media sheet positioned in the nip moves in the first direction towards the reference edge. In this way, sheets of media may be aligned relative to the reference edge for a post-processing operation to be subsequently performed thereon.

In one embodiment, only the second roll is coupled to the drive mechanism for translation. In another embodiment, a coupling device is provided to the system for coupling the first roll to the drive mechanism, the first roll translating with the second roll in the first direction. In this embodiment, a media sheet positioned in the nip is moved towards the reference edge.

In an example embodiment, the axis of rotation of the second roll may be placed at an angle other than an orthogonal angle with respect to the media feed direction.

The system may further include a third roll mounted across the media path and a fourth roll mounted relative to the third roll so as to define a second nip between the third and the fourth roll. In one embodiment, the nip between the third and fourth rolls is positioned downstream and above the nip between the first roll and the second roll. One of the third and fourth roll may be a driven roll. In another embodiment, the second nip is positioned adjacent to the first nip, and the driven roll of the second nip rotates together with the driven roll of the first nip. The drive mechanism can be one of a cam device and a rack gear.

The system may further include a sensing device for determining a location of a leading edge of the media sheet in the media path, and upon a positive determination causing the drive mechanism to translate the second roll a first distance in the first direction from a home position towards the reference edge. A sensing device may also be provided for determining a location of a trailing edge of the media sheet in the media path, and upon a positive determination causing the drive mechanism to translate the second roll a second distance in a second direction away from the reference edge and towards the home position, wherein the first distance is substantially equal to the second distance. Another sensing device maybe positioned adjacent to the reference edge for determining a location of a lateral edge of the media sheet, and upon a positive determination stopping the movement of the second roll toward the reference edge.

BRIEF DESCRIPTION OF THE DRAWINGS

The above-mentioned and other features and advantages of the various embodiments of the invention, and the manner of attaining them, will become more apparent and will be better understood by reference to the accompanying drawings, wherein.

DETAILED DESCRIPTION

Figure 1:
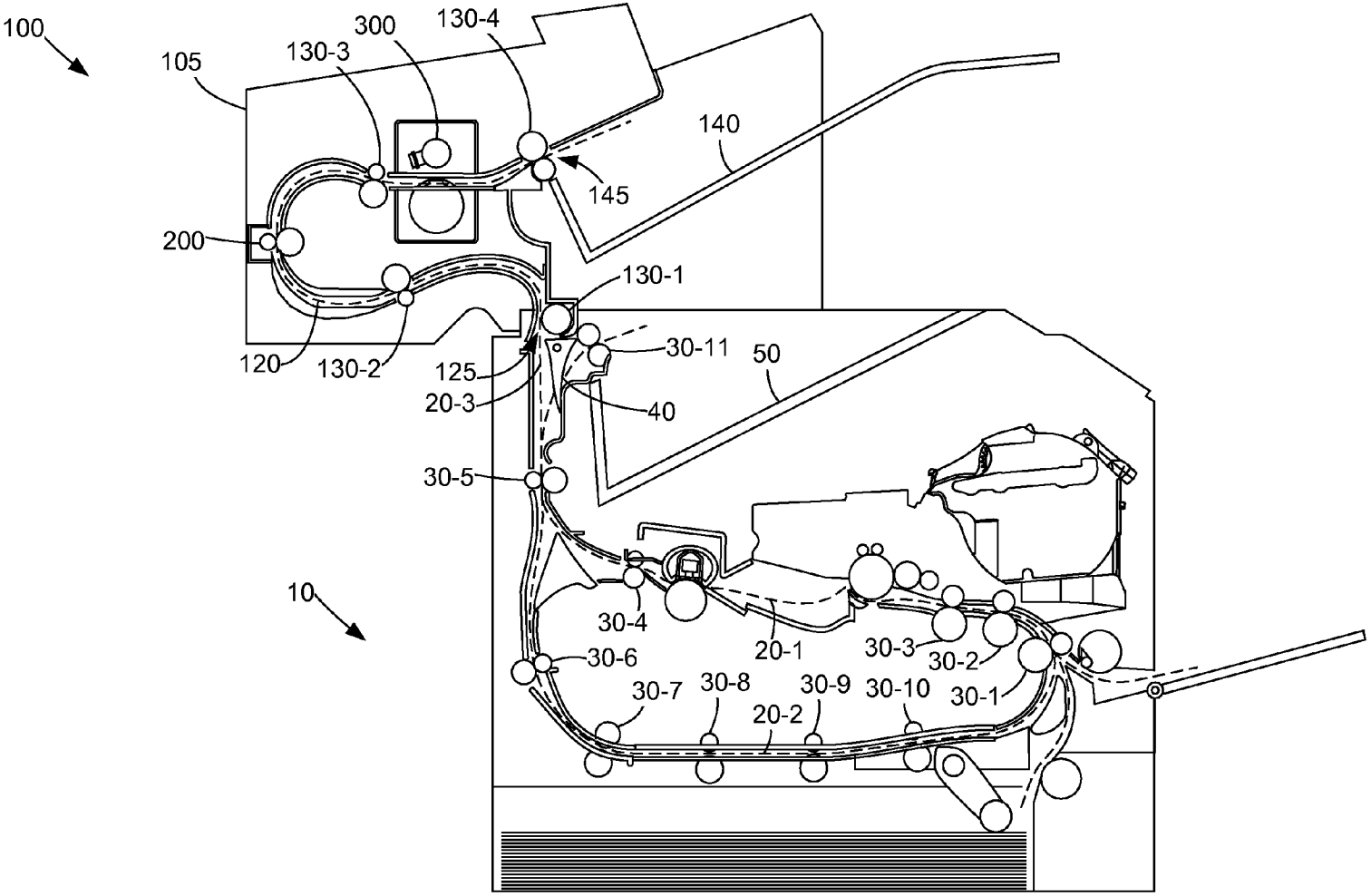
FIG. 1 is a side elevational view of an imaging apparatus and a post-processing device mounted on the imaging apparatus according to an embodiment.

The following description and drawings illustrate embodiments sufficiently to enable those skilled in the art to practice it. It is to be understood that the disclosure is not limited to the details of construction and the arrangement of components set forth in the following description or illustrated in the drawings. The invention is capable of other embodiments and of being practiced or of being carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limited sense, and the scope of the present invention is defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The present disclosure provides an alignment system for an imaging apparatus, such as a printer. In particular, the alignment system of the present disclosure may be used in a post-processing device for aligning a media sheet undergoing movement within a media path prior to reaching a finishing mechanism of the post-processing device, such as a hole puncher.

Referring now to the drawings and particularly to FIG. 1, there is shown a post-processing device 100 mounted on an imaging apparatus 10. Imaging apparatus 10 includes a simplex printing media path 20-1 defined by transport roller pairs 30-1, 30-2, 30-3, 30-4, 30-5, and 30-11, and a duplex printing media path 20-2 defined by transport roller pairs 30-6, 30-7, 30-8, 30-9, and 30-10. The media paths 20-1, 20-2 include a diverter 40 adapted to direct the printed media sheets either toward the media path 20-3 or toward an output bin 50 of imaging apparatus 10. Meanwhile, the post-processing device 100 includes a media path 120 having transport roller pairs 130-2, 130-3, and 130-4. The post-processing device 100 also includes a bin 140 for receiving media outputted from transport roller pair 130-4. The post-processing device 100 is mounted on the imaging apparatus 10 in a manner such that a transport roller 130-1 at the inlet 125 of the post-processing device 100 is positioned adjacent to the media sheet path 20-3 of the imaging apparatus 10 to receive printed media sheets therefrom. Though post-processing device 100 is depicted in FIG. 1 as being separate from imaging apparatus 10, it is understood that in other embodiments post-processing device 100 may be disposed substantially entirely within imaging apparatus 10. It is further understood that post-processing device 100 may be mounted on or otherwise associated with apparatuses other than imaging apparatus 10 for performing one or more functions with respect to sheets received thereby.

Diverter 40 may be instructed and/or positioned to block media sheet path 20-3 when the imaging apparatus 10 is instructed to perform only a printing function. On the other hand, when the imaging apparatus 10 is instructed to perform a finishing function, such as hole punching, along with and/or following the printing function, diverter 40 is positioned to allow the printed media sheets to leave image forming apparatus 10 from an opening in a wall of the housing thereof, such as, for example, the upper rear wall, enter inlet 125 and move along media path 120. In the example embodiment illustrated, media path 120 is generally C-shaped path. It is understood, however, that media path 120 may have other shapes which may or may not depend upon the specific function performed by post-processing device 100.

Figure 2:
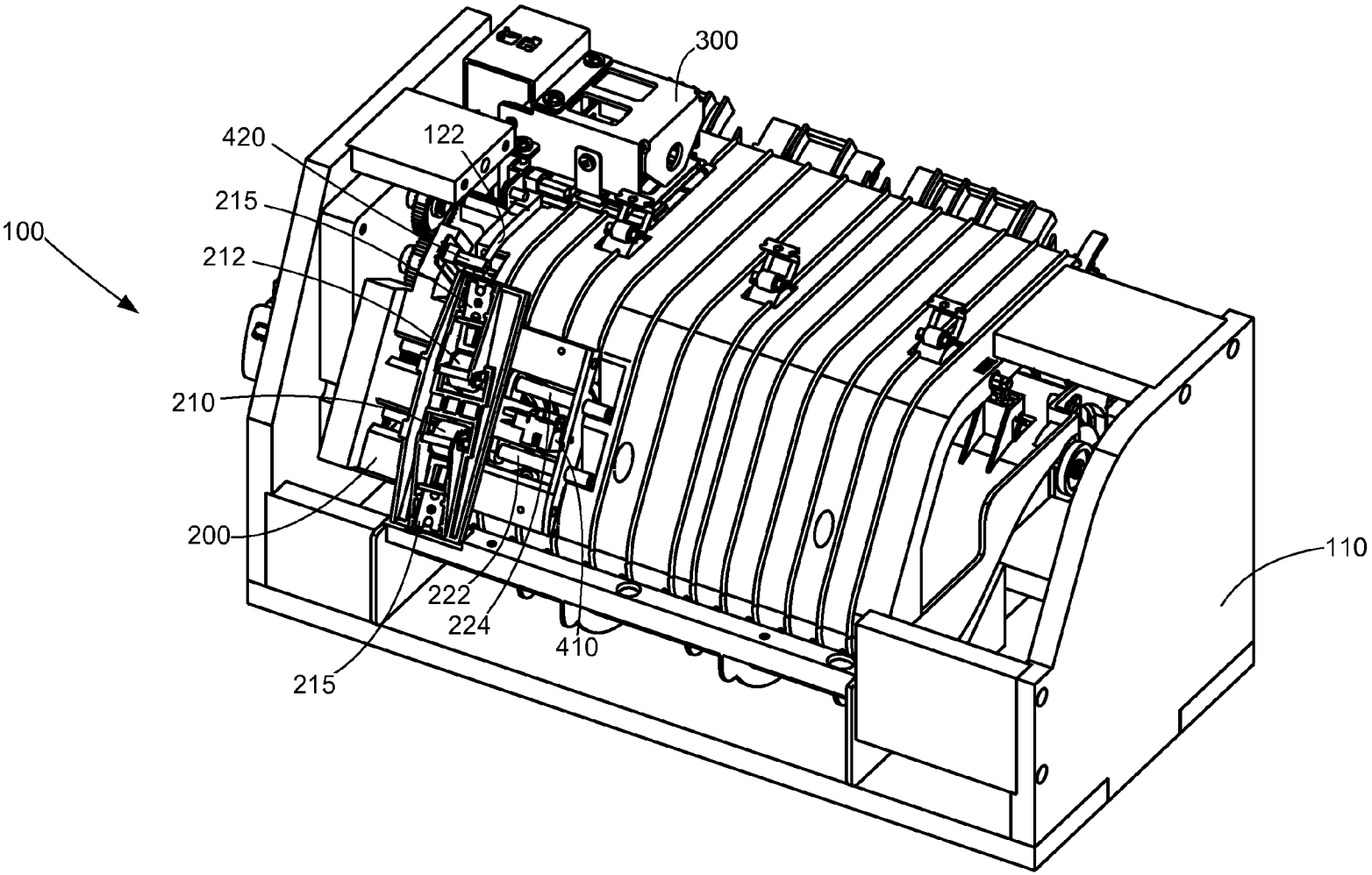
FIG. 2 is a perspective view of one example embodiment of the post-processing device of FIG. 1.

In one exemplary embodiment as shown in FIG. 1 and FIG. 2, the post-processing device 100 may include a housing 105 having inlet 125 and outlet 145, a support frame 110 mounted within the housing 105, an alignment system 200 disposed along the media path 120 for aligning and correcting the skew of a media sheet, and a finishing device such as a hole puncher 300 positioned further downstream along the media path 120 for performing a finishing operation.

In one example embodiment, a media sheet leaving the image forming apparatus 10 and entering the post-processing device 100 is referenced to the right side (with respect to the view of FIG. 2) and a finishing device such as a hole puncher 300 may be positioned at the left side of the post-processing device 100. In such an example scenario, there is a need to shift the media sheet from being referenced to the right to a reference edge position at the left side for post-processing device 100. Alternatively, the media sheet leaving the image forming apparatus 10 and entering the post-processing device 100 is referenced to the left side and the finishing device may be positioned at the right side of the post-processing device 100. In such alternative scenario, there is a need to shift the media sheet from being referenced to the left to a reference edge position at the right side for post-processing device 100. In yet another alternative scenario, the media sheet leaving the image forming apparatus 10 and entering the post-processing device 100 is center-fed and the finishing device may be positioned either at the right or left side of the post-processing device 100. In such alternative scenario, there is a need to shift the media sheet towards a reference edge position where the post-processing device 100 is positioned.

Figure 3:
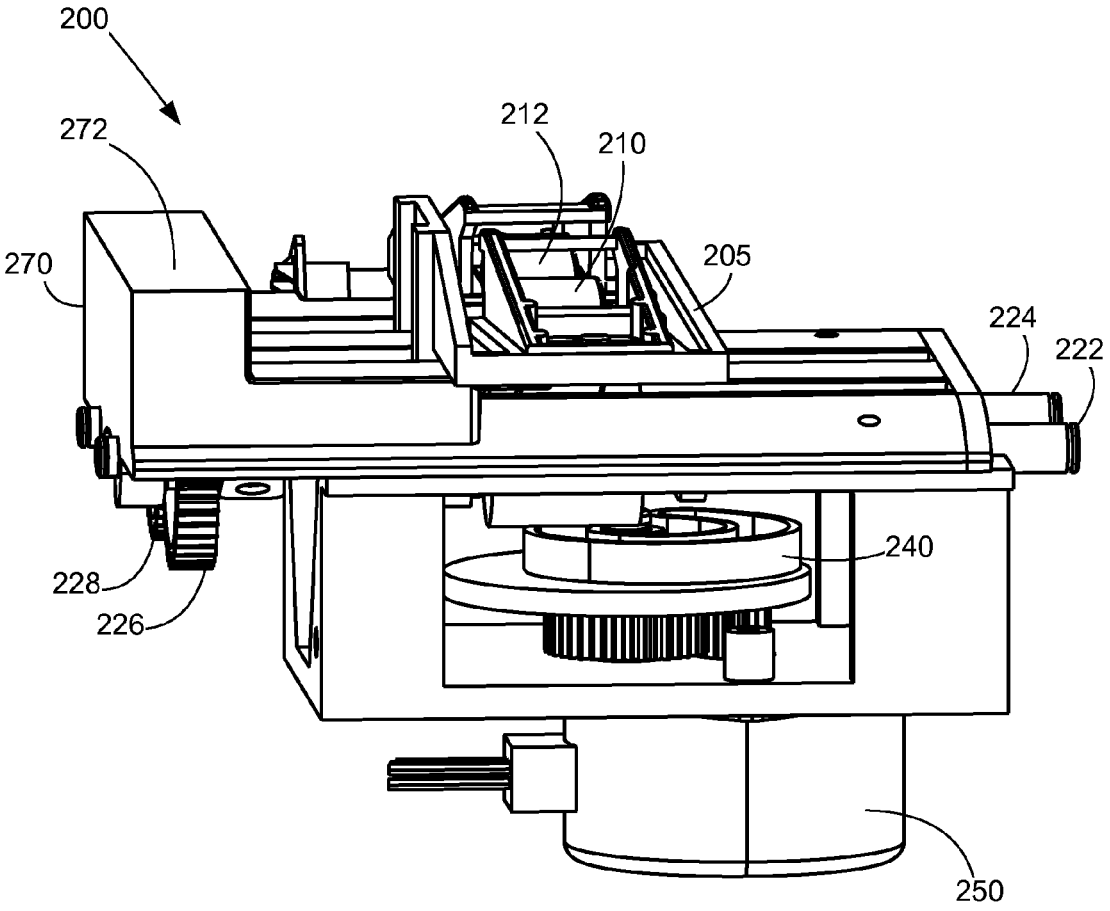
FIG. 3 is a side perspective view of one example embodiment of an alignment system of the post-processing device of FIG. 2.
Figure 4:
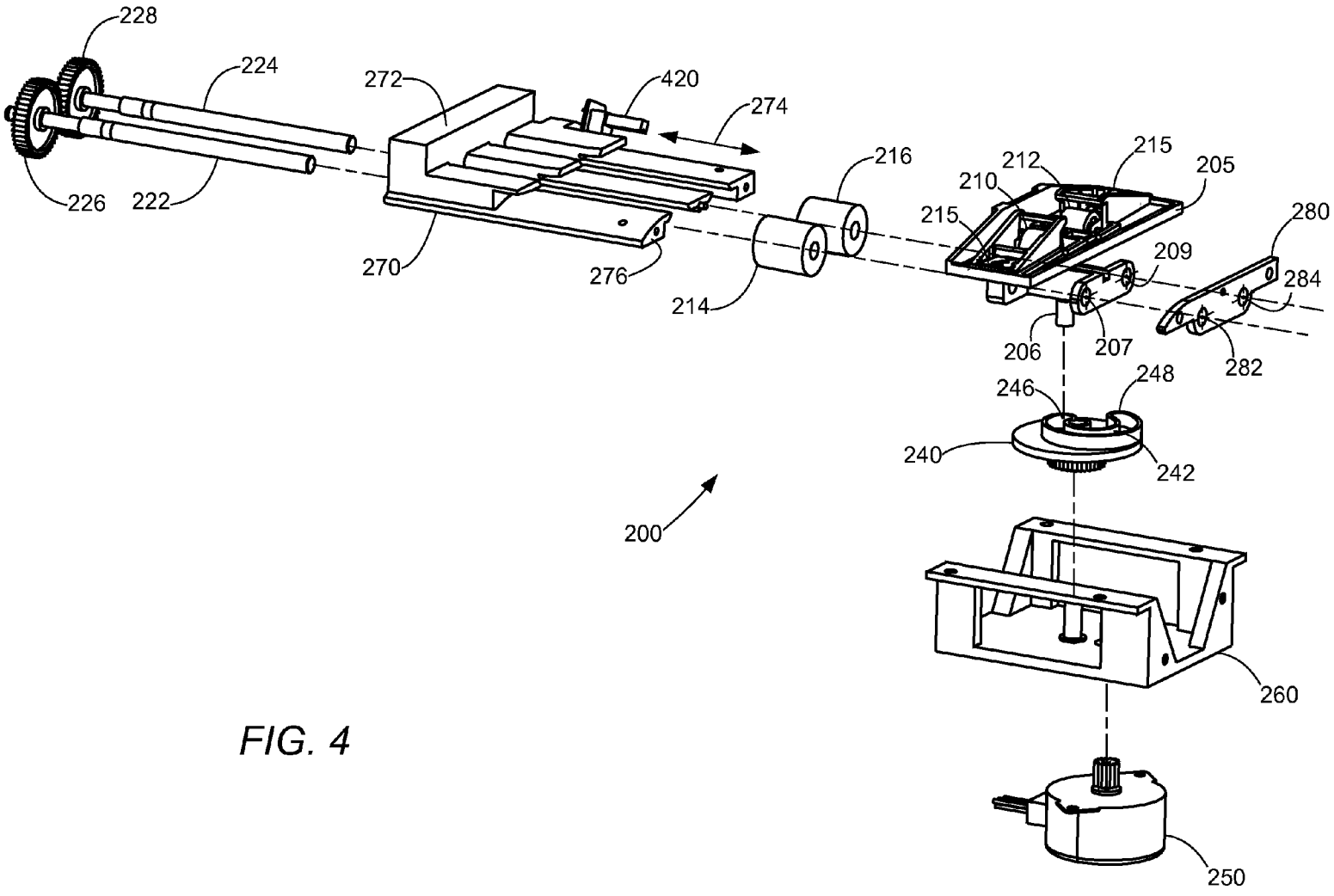
FIG. 4 is an exploded perspective view of the alignment system of FIG. 3.
Figure 6:
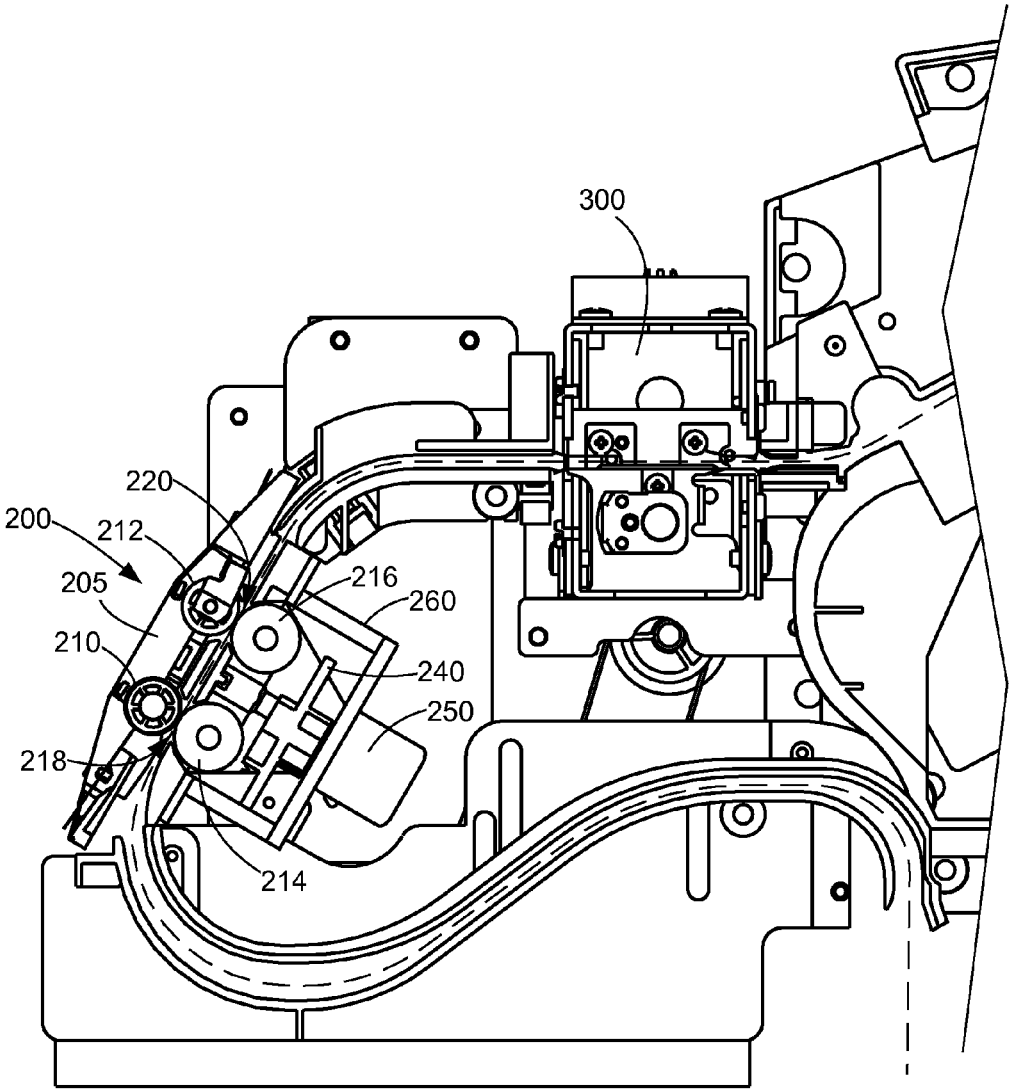
FIG. 6 is a side sectional view of the example embodiment of post-processing device of FIG. 2.
Figure 7:
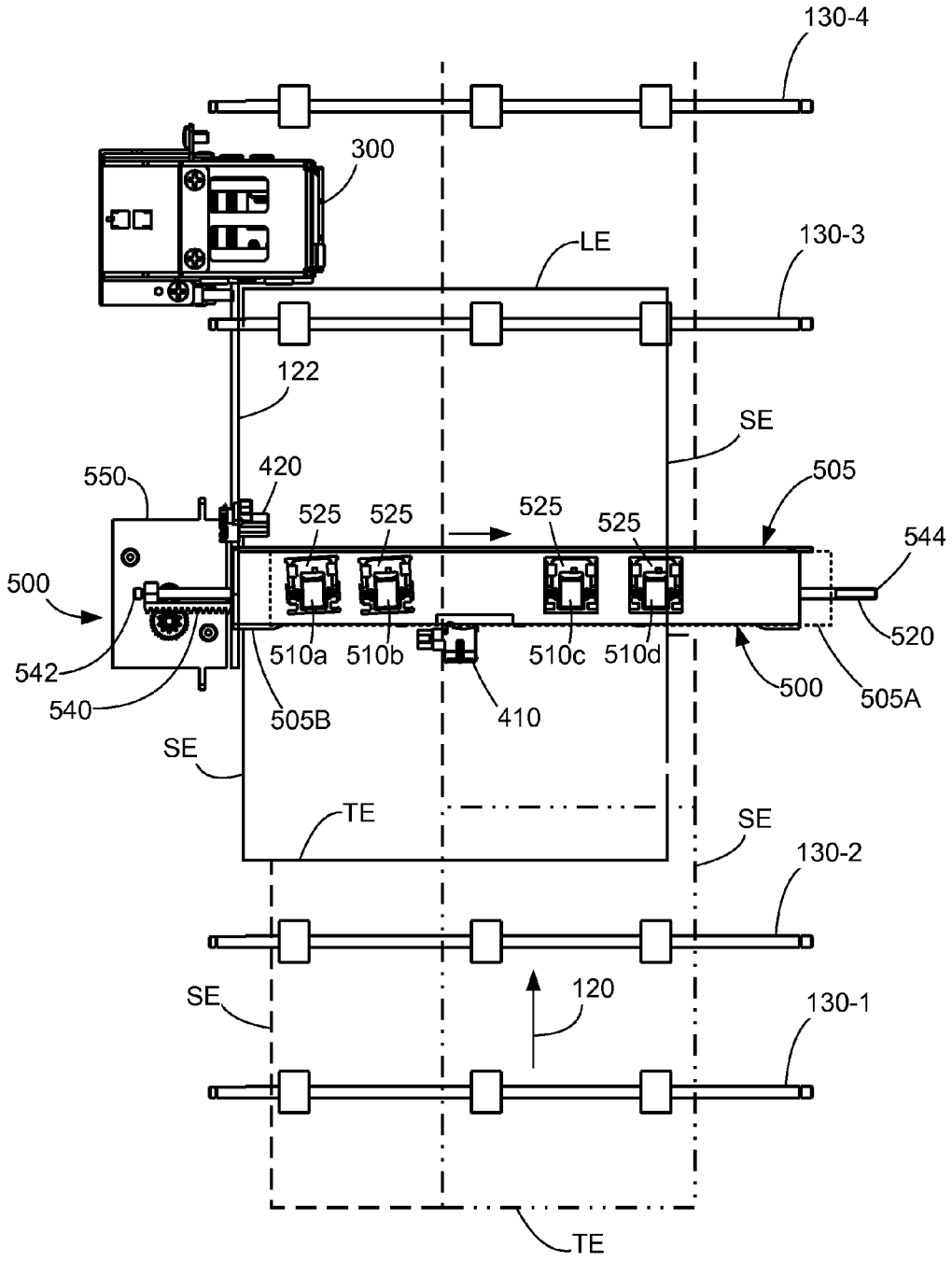
FIG. 7 schematically illustrates how the media sheet is translated from a first position to a second position according to another example embodiment of the post-processing device.

In an example embodiment illustrated in FIGS. 3 and 4, the alignment system 200 may include a translating bracket 205 having two deskew rollers 210, 212 rotatably supported thereon. As shown in FIG. 2, the first deskew roller 210 is positioned to have a separate rotational axis to that of the second deskew roller 212. However, it is also contemplated in another embodiment to have the first deskew roller 210 spaced apart laterally from the second deskew roller 212 such that the first deskew roller 210 and the second deskew roller 212 share a common rotational axis. The alignment system 200 also includes a first driven roller 214 rotatably supported and driven on a first shaft 222 and a second driven roller 216 rotatably supported and driven on a second shaft 224. The first and second driven rollers 214, 216 are in contact with the deskew rollers 210, 212, respectively, such that the first deskew roller 210 and the first driven roller 214 form a first alignment nip 218 and the second deskew roller 212 and the second driven roller 216 form a second alignment nip 220 (best seen in FIG. 6).

Each of deskew rollers 210, 212 may be operatively coupled to a bias mechanism such as a springs 215 in order to create a nip force with the respective driven rollers 214, 216. In one embodiment, each spring 215 creates a nip force of about 0.5 to about 2 lbs. In one embodiment, the deskew rollers 210, 212 are formed from a material that is harder than the material of driven rollers 214, 216. The nip force may result in slight deformation of the driven rollers 214, 216 because the biasing force of the spring 215 slightly alters the position of the rotational axes of the deskew rollers 210, 212 to intersect with the plane of the media path 120. A motor (not shown) may drive the first and second driven rolls 214, 216 in a forward direction to move the media sheet further along the media path 120. The size of the driven rolls 214, 216 may vary, and in one embodiment the diameter of the driven rollers 214, 216 may be larger than the diameter of the deskew rollers 210, 212. In another example embodiment, the length of the driven rollers 214, 216 may be longer than the length of the deskew rollers 210, 212. In another contemplated embodiment, the first and second shafts 222, 224 are coupled to the translating bracket 205 such that the first and second shafts 222, 224 carrying driven rollers 214, 216, respectively, translate together with the translating bracket 205. The translating bracket 205 has apertures 207, 209, for receiving first and second shafts 222, 224, respectively.

The alignment system 200 also includes a cam gear 240 driven by a stepper motor 250 mounted on stationary mount 260. A stud 206 of the translating bracket 205 is received within an arcuate slot 242 formed along a surface of cam gear 240 such that forward rotational movement of a shaft of the stepper motor 250 causes rotational movement of the cam gear 240 which consequently moves the stud 206 from the smaller radius portion 246 to the larger radius portion 248 of the slot 242. Conversely, the stepper motor 250 can be operated to rotate its shaft in the reverse direction wherein the cam gear 240 moves the stud 206 from the larger radius portion 248 to the smaller radius portion 246 of the slot 242.

Mounted on mount 260 is a bracket 270 for providing the sliding path 274 of the translating bracket 205. A capping member 280 having apertures 282, 284 sized to receive and rotatably support first and second shafts 222, 224, respectively, may be mounted on the side surface 276 of the bracket 270 to limit the sliding movement of the translating bracket 205 within the sliding path 274. In such manner, the translating bracket 205 is constrained to move along the direction of the first and second shafts 222, 224 upon movement of the stud 206 from the smaller radius portion 246 to the larger radius portion 248 of the slot 242 of cam gear 240. Each of the first and second shafts 222, 224 has at least one end having a D-cut section fixedly attached to the translating bracket 205 using an e-clip (not shown). Supported near the D-cut ends of the first and second shafts 222, 224 are drive gears 226, 228, respectively, that provide rotational movement for each of the first and second shafts 222, 224. Drive gears 226, 228 each have D-cut hubs (not shown) adapted to receive and permit axial sliding movement of D-cut ends of each of the first and second shafts 222, 224 upon movement of the translating bracket. Drive gears 226, 228 are positioned to engage with a compound gear (not shown) that is driven by a motor (not shown), thereby causing the rotation of the first and second shafts 222, 224. The axial movement of the drive gears 226, 228 is limited within the gear compartment 272 of bracket 270.

Figure 5:
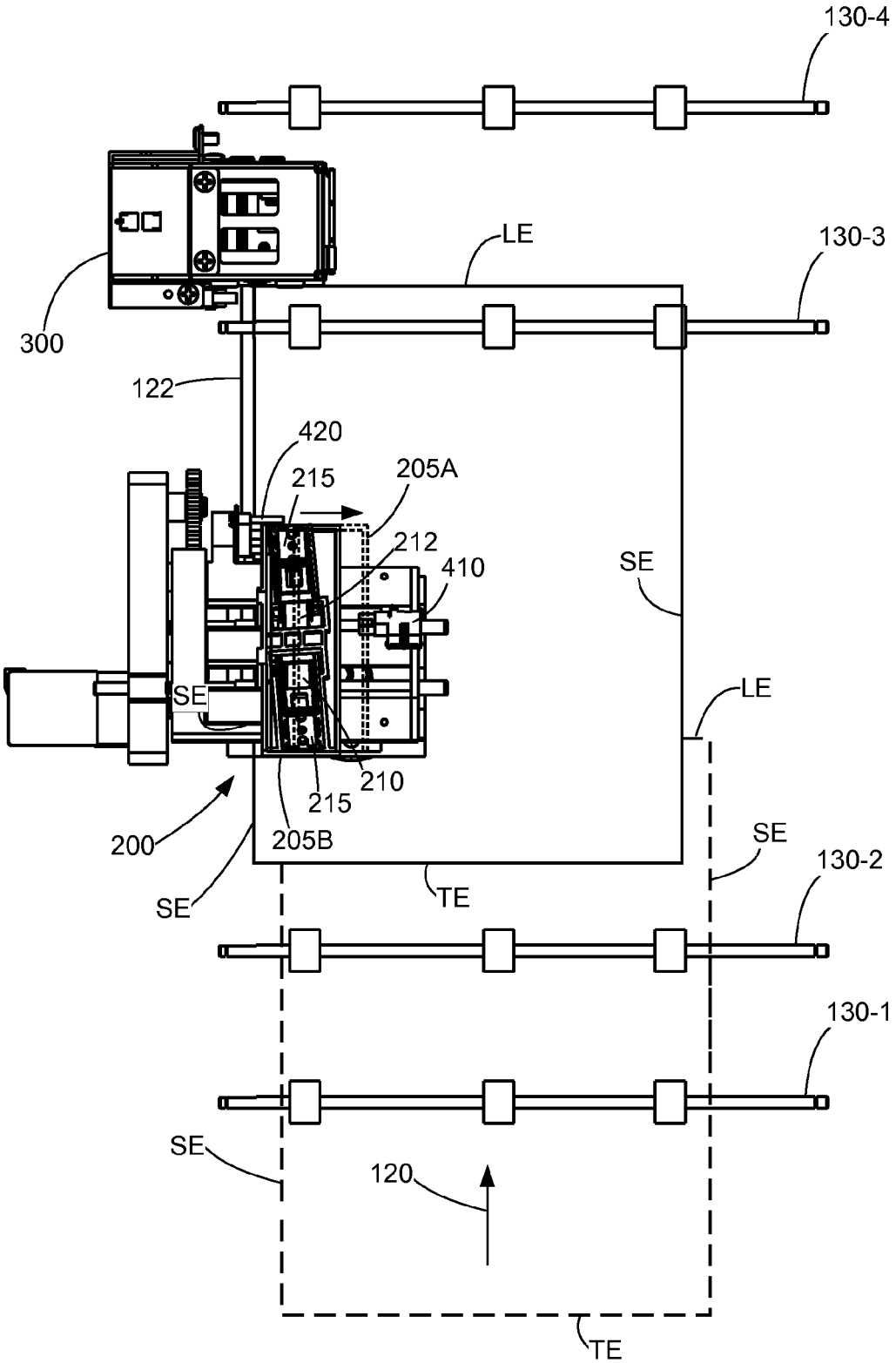
FIG. 5 schematically illustrates how the media sheet is translated from a first position to a second position by the alignment system of FIG. 3.
Figure 12:
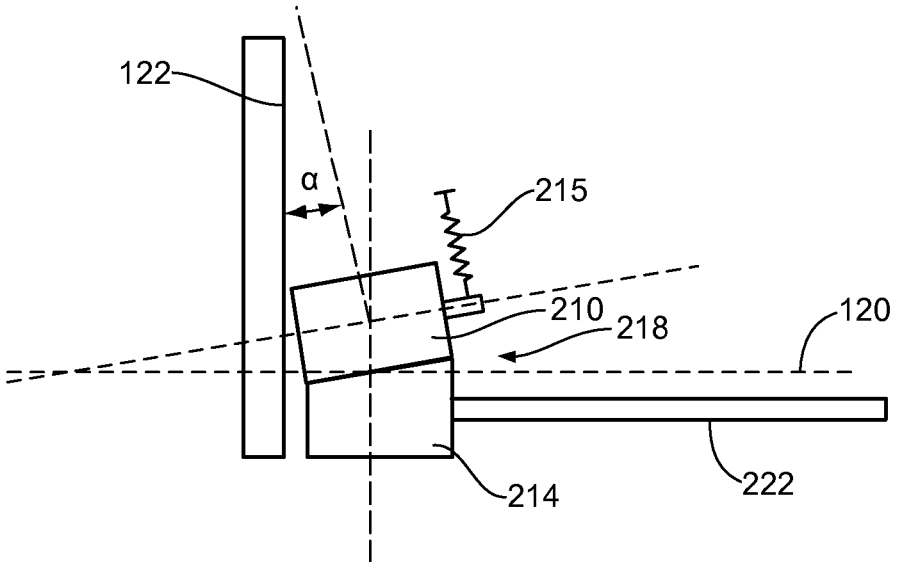
FIG. 12 is a schematic view of a drive roll and backup roll positioned relative to a reference edge according to one embodiment.

In one example embodiment, one or more sensors may be used to track the position of the media sheet along the media path 120. Specifically, one or more sensors may be used to detect when leading and trailing edges of a printed media sheet pass in proximity to the one or more sensors. The one or more sensors may also determine if a jam of a printed media sheet on media path 120 has occurred. With reference to FIG. 5, positioned adjacent to a reference edge 122 is a photosensor 420 for tracking the position of a lateral edge SE of the media sheet. In one example embodiment, the photosensor 420 is positioned to detect the position of the lateral edge SE about 1 mm away from the reference edge 122 in order to prevent the media sheet from buckling or jamming against the reference edge 122. The remaining lateral distance is compensated by the deskewing action provided by the alignment nips 218, 220. The alignment nips 218, 220 align the media sheet by directing the media sheet to contact and align against the reference edge 122. To accomplish the alignment, a centerline and/or axis of rotation of each of the deskew rollers 210, 212 is positioned at an angle $\alpha$ relative to the reference edge 122 (see FIG. 12). This positioning causes the media sheet to move through the first and second alignment nips 218, 220 and towards the reference edge 122. The angle $\alpha$ may vary between about $>0°$ and $10°$. In one specific embodiment, the angle $\alpha$ is about $5°$.

As illustrated in FIG. 5, a mechanical flag type pass through sensor 410 may be provided adjacent to the alignment system 200 for tracking the position of the media sheet along the media path 120. In a mechanical flag type sensor, a leading edge LE of a media sheet is detected when the flag is actuated, e.g., when the flag rotates away from media path 120, and a trailing edge TE of the media sheet is detected when the flag returns to the non-actuated state. Alternatives include those wherein pass through sensor 410 is a photosensor. The photosensor may include a light emitting diode that transmits a signal and a phototransistor that receives the signal. The signal is interrupted when the media sheet passes the sensor thus indicating location.

The operation of the alignment system 200 according to the present disclosure will now be described in greater detail below with reference to the accompanying drawings.

A media sheet scheduled for a finishing operation such as hole punching leaves the imaging apparatus 10 through media path 20-3, enters the inlet 125 of the post-processing device 100 and moves into media path 120 through transport roller pairs 130-1, 130-2, 130-3, and 130-4. In one example embodiment, the media sheet speed is about 385 mm/sec, corresponding to about 70 pages per minute. When the leading edge of the printed media sheet is detected by sensor 410, a controller directs the alignment system 200 to translate the translating bracket 205 from the home position 205A to the shifted position 205B, as shown in FIG. 5. In an example embodiment, the translating bracket 205 will commence movement from the home position 205A to the shifted position 205B after the leading edge LE of the media sheet has advanced about 65 mm from the sensor 410. The stepper motor 250 drives the cam gear 240 in the forward direction so as to rotate the cam gear 240 in the clockwise direction (as viewed from FIG. 4) which causes the stud 206 of the translating bracket 205 to move from the smaller radius portion 246 to the larger radius portion 248 of the slot 242. The movement of the stud 206 from the smaller radius portion 246 to the larger radius portion 248 of the slot 242 results in a linear sliding movement of the translating bracket 205 from home position 205A towards a reference edge 122 positioned along a side of the media path 120. Such linear sliding movement is substantially lateral and orthogonal to the direction of movement of the media sheet along media path 120.

In an example embodiment, the moving media sheet is shifted towards the reference edge 122 by a dragging force exerted by the deskew rollers 210, 212 as the deskew rollers 210, 212 carried by the translating bracket 205 move with bracket 205 from the home position 205A towards the reference edge 122. In another example embodiment, the moving media sheet is carried by the alignment nips 218, 220 during movement of the translating bracket 205 together with the driven rollers 214, 216 towards the reference edge 122.

When the photosensor 420 detects the lateral edge SE of the media sheet near the reference edge 122, the controller instructs the stepper motor 250 to stop until further instruction is transmitted from the controller. When the sensor 410 detects the trailing edge TE of the media sheet, the controller communicates with the stepper motor 250 to drive the cam gear 240 in the reverse direction, i.e., counter-clockwise with respect to the view of FIG. 4, such that the rotation of the cam gear 240 in the reverse direction causes the stud 206 of the translating bracket 205 to move from the larger radius portion 248 to the smaller radius portion 246 of the slot 242. The movement of the stud 206 from the larger radius portion 248 to the smaller radius portion 246 of the slot 242 results in a linear sliding movement of the translating bracket 205 from the reference edge 122 back to the home position 205A. In an example embodiment, the translating bracket 205 commences movement from the shifted position 205B to the home position 205A after the trailing edge TE has advanced about 40 mm from the sensor 410. This operation of the aligning system 200 repeats for every media sheet passing through the media path 120 that is scheduled for a finishing operation. In an example embodiment, the alignment system 200 allows for about a 70 mm interpage gap between consecutive media sheets.

Figure 8:
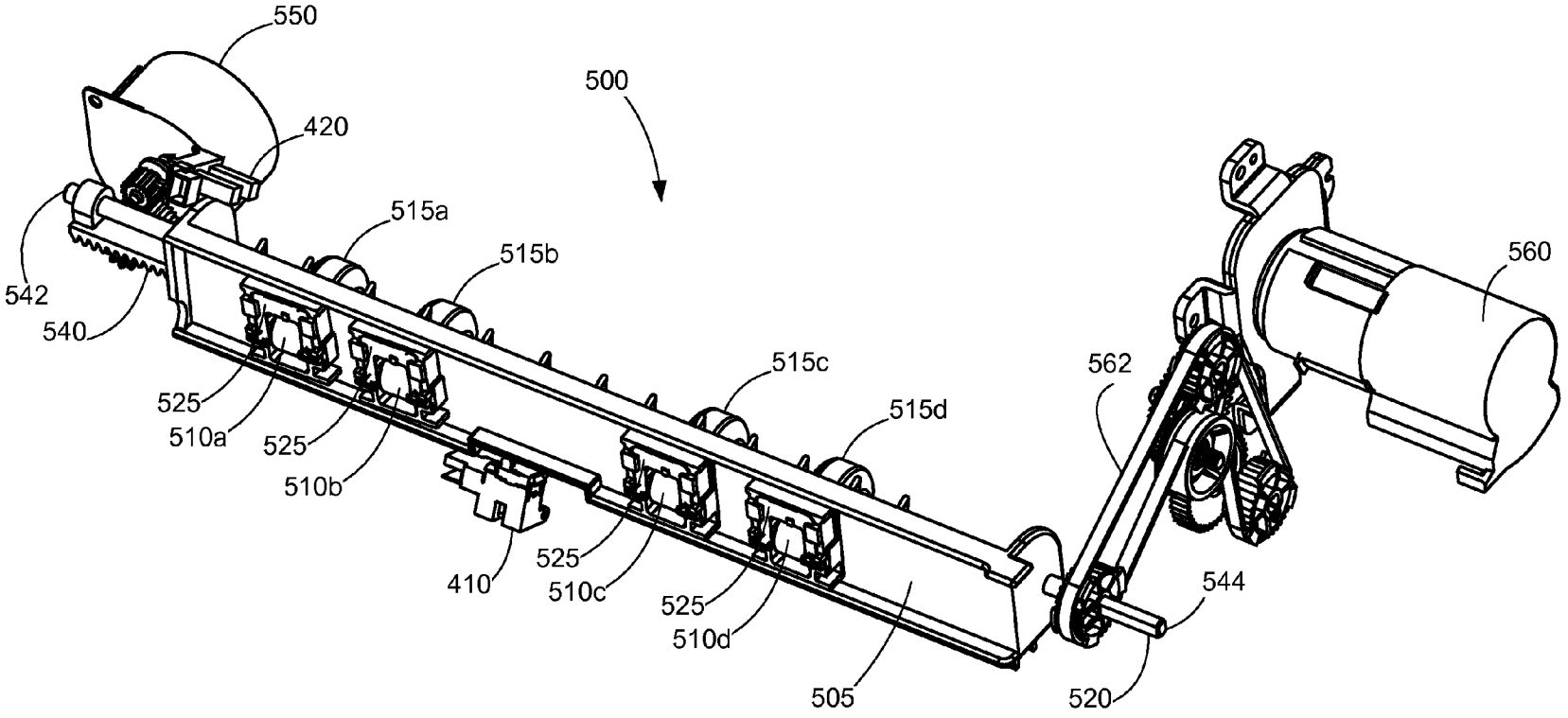
FIG. 8 is a perspective view of another example embodiment of an alignment system.
Figure 9:
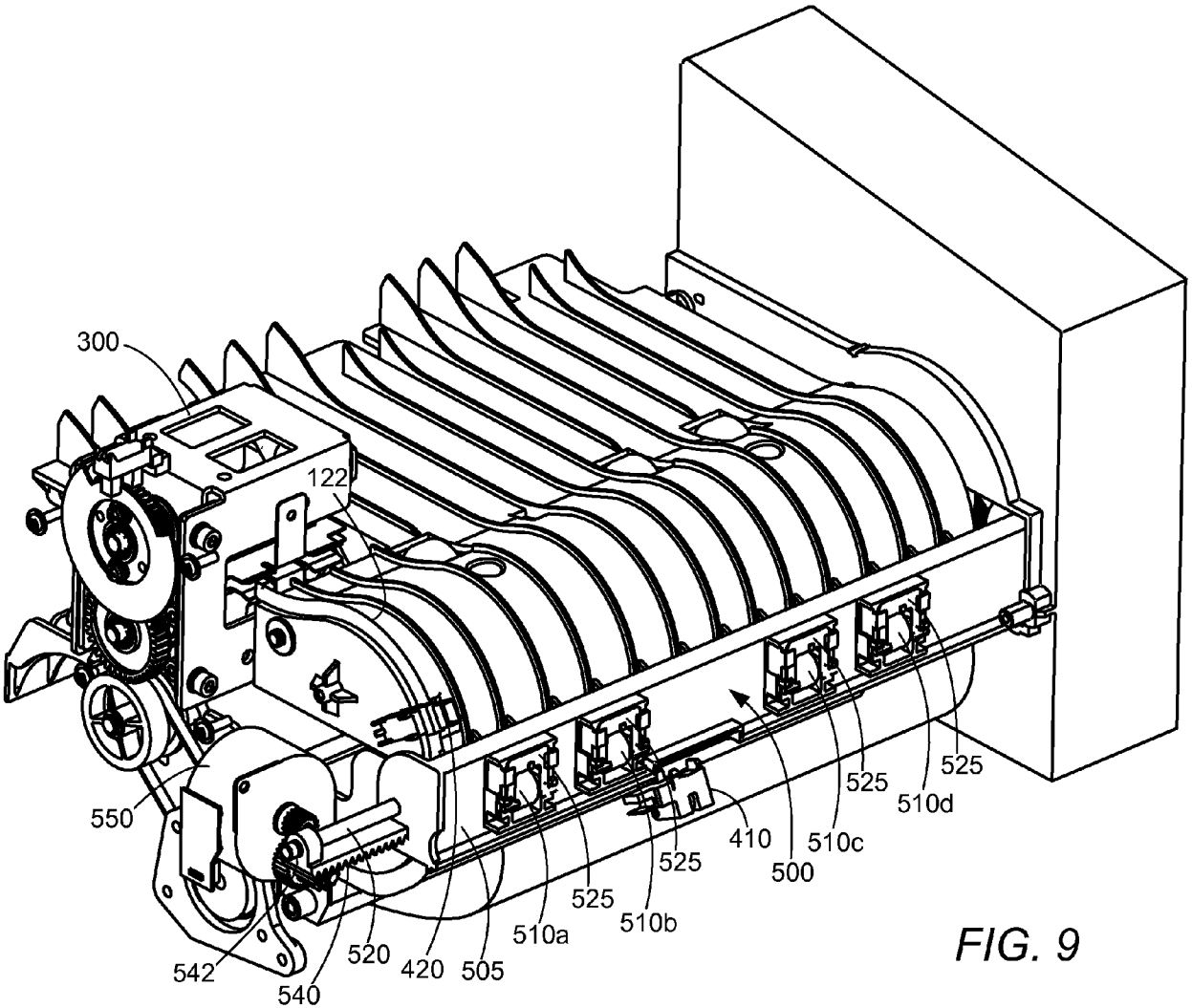
FIG. 9 is perspective view of an example embodiment of a post-processing device having the alignment system shown in FIG. 8 showing a media sheet prior to alignment.

In another example embodiment illustrated in FIGS. 7-11, the alignment system 500 may include a sliding member 505 having a plurality of backup rollers 510*a*, 510*b*, 510*c*, 510*d* rotatably supported thereon. As shown in FIG. 8, backup rollers 510*a*, 510*b*, 510*c*, 510*d* are spaced laterally across the width of the media path 120 (see FIG. 7). Each of the backup rollers 510*a*, 510*b*, 510*c*, 510*d* is positioned to contact a respective driven roller from a plurality of driven rollers 515*a*, 515*b*, 515*c*, 515*d* mounted on a shaft 520, each pair of rollers 510*a* and 515*a*, 510*b* and 515*b*, 510*c* and 515*c*, and 510*d* and 515*d* forming a nip therebetween. A biasing means such as spring 525 may be operatively connected to the backup rollers 510*a*-510*d* to create a nip force with the respective driven rollers 515*a*-515*d*. In one embodiment, the spring 525 creates a nip force of about 0.5 lbs to about 2 lbs. In one embodiment, the backup rollers 510*a*-510*d* are harder than the driven rollers 515*a*-515*d*. The nip force may result in slight deformation of the driven rollers 515*a*-515*d* because the biasing force of the spring 525 slightly alters the position of the rotational axes of the backup rollers 510*a*-510*d* to intersect with the plane of the media path 120. In one example embodiment, the length of the driven rollers 515*a*-515*d* may be longer than the length of the backup rollers 510*a*-510*d*. In another example embodiment, there may be two driven rollers (not shown) mounted on shaft 520, one driven roller positioned to be in contact with backup rollers 510*a* and 510*b*, and another driven roller positioned to be in contact with backup rollers 510*c* and 510*d*. In yet another example embodiment, there may be a single driven roll (not shown) positioned to be in contact with backup rollers 510*a*-510*d*. The radial size of the driven rollers 515*a*-515*d* may vary, and in one embodiment the diameter of the driven rollers 515*a*-515*d* may be larger than the diameter of the backup rollers 510*a*-510*d*.

In much the same way as the earlier described embodiment, one or more backup rollers 510, such as backup rollers 510*a* and 510*b*, may each be positioned to have its rotational axis offset from an angle that is orthogonal to the media feed direction of media sheets along media path 120. The offset may result in or otherwise form an acute angle between the rotational axes and the media feed direction. A motor 560 (FIG. 8) may drive the driven rollers 515*a*-515*d* in a forward direction to move the media sheet further along the media path 120. Motor 560 may be coupled to driven rollers 515*a*-515*d* via a drive belt 562 or other suitable coupling mechanism. In another contemplated embodiment, the shaft 520 carrying the driven rollers 515*a*-515*d* is coupled to the sliding member 505 such that the nip is maintained between the rollers 510*a* and 515*a*, 510*b* and 515*b*, 510*c* and 515*c*, and 510*d* and 515*d* when the sliding member 505 moves to shift the media sheet to contact and align against the reference edge 122. The sliding member 505 may further include, at a first end 542, a rack gear portion 540 that is driven by a stepper motor 550. The alignment system 500 includes sensors 410 and 420 that are coupled within the system and used in much the same way as the earlier described embodiment. Additionally, an additional photosensor (not shown) may be provided adjacent to a second end 544 of the sliding member 505 for detecting the position of the second end of the sliding member 505. When the second end 544 is detected, the controller instructs the stepper motor 550 to stop until further instruction is transmitted from the controller.

The operation of the alignment system 500 according to the present disclosure will now be described in greater detail below with reference to the accompanying drawings.

A media sheet scheduled for a finishing operation, such as hole punching, leaves the imaging apparatus 10 through media path 20-3, enters the inlet 125 of the post-processing device 100 and moves into media path 120 through transport roller pairs 130-1, 130-2, 130-3, and 130-4. When the sensor 410 detects the leading edge LE of the media sheet (FIG. 9), the controller communicates with the stepper motor 550 of the alignment system 500. In one example embodiment, the stepper motor 550 commences forward operation after the leading edge LE of the media sheet has advanced about 70 mm from the sensor 410 (FIG. 10).

In an alternative embodiment, the sensor 410 may be configured to selectively detect and track the position of the media sheet based on the width of media. For example, in one embodiment, the sensor 410 may be positioned away from the media path of a narrow media such that the sensor 410 is only capable of detecting wide media sheets. When a narrow media sheet moves through the media path 120, the sliding member remains in the home position 505A so that no lateral translation is performed. This may be utilized when the post-processing device is configured to perform the finishing function only on wider media.

Figure 10:
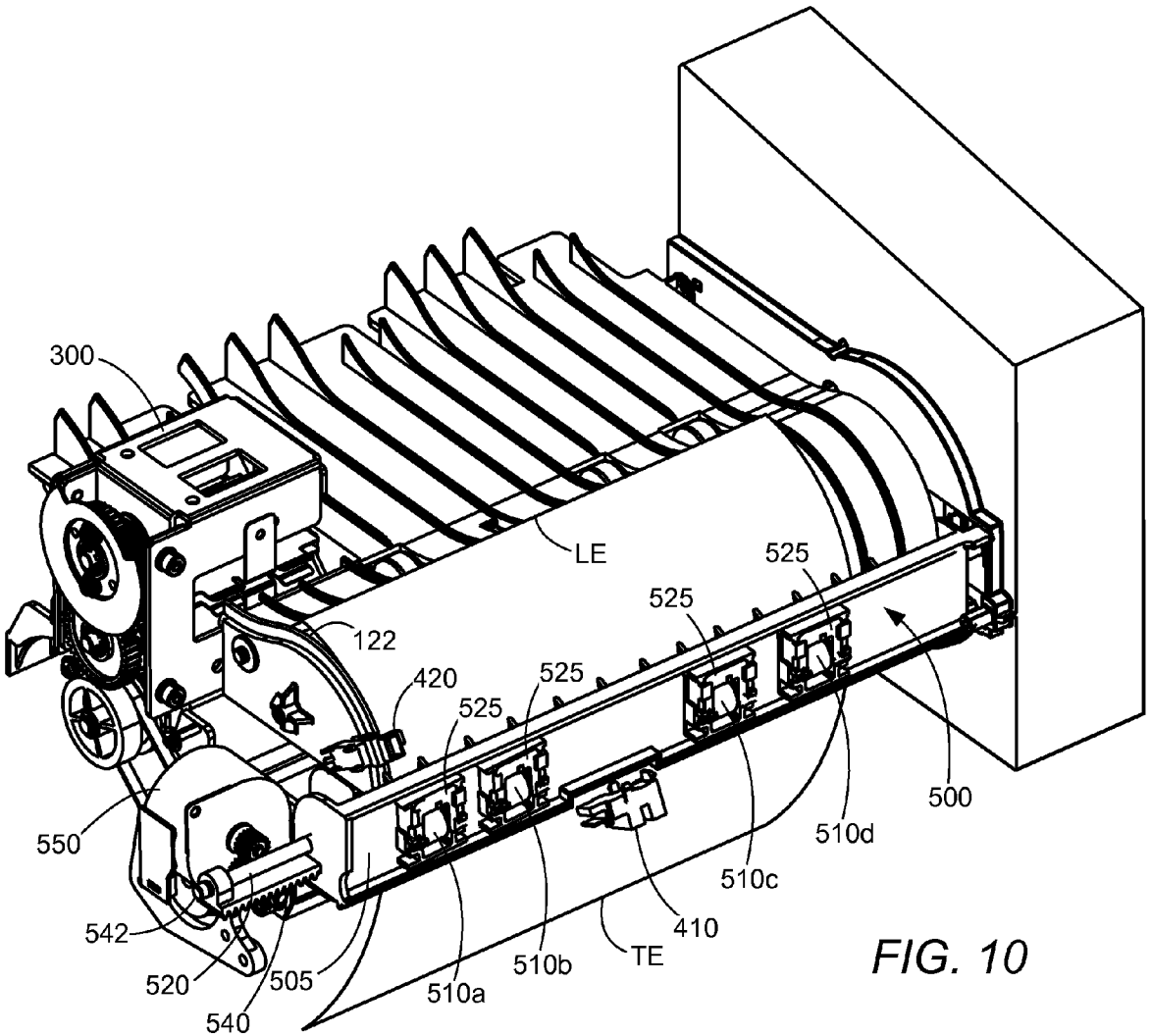
FIG. 10 is perspective view of an example embodiment of the post-processing device of FIG. 9 showing a media sheet aligned to a side reference edge.
Figure 11:
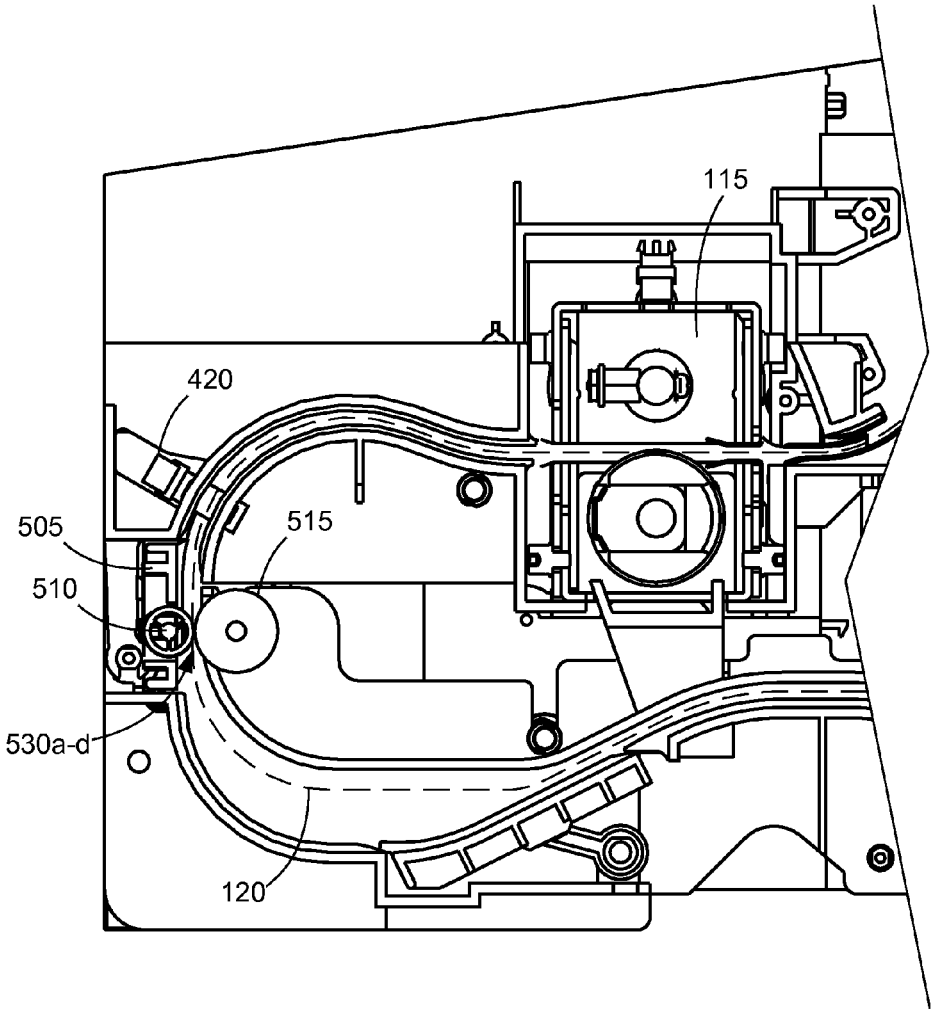
FIG. 11 is a side sectional view of the example embodiment of post-processing device of FIG. 9.

In response to the controller communicating to stepper motor 550 the detection of the leading edge LE of the media sheet, the stepper motor 550 engages and drives the rack gear portion 540 in the forward direction such that the sliding member 505 and the driven rollers 515*a*-515*d* move from home position 505A towards the reference edge 122 positioned along a side of the media path 120 (FIG. 10). In one example embodiment, the moving media sheet is carried by the alignment nips 530*a*-530*d* during movement of the sliding member 505 together with the driven rollers driven rollers 515*a*-515*d* towards the reference edge 122. The photosensor 420 detects the position of the lateral edge SE relative to the reference edge 122 in order to prevent the media sheet from buckling or jamming against the reference edge 122. The remaining lateral distance is compensated by the deskewing action provided by the alignment nips 530*a* and 530*b* (FIG. 11) that align the media sheet in much the same way as how the first and second alignment nips 218, 220 align the media sheet of the earlier described embodiment.

When the photosensor 420 detects the lateral edge SE of the media sheet being near reference edge 122, the controller instructs the stepper motor 550 to stop until further instruction is transmitted from the controller. When the controller determines that the trailing edge TE of the media sheet has moved beyond the sensor 410, i.e. when the sensor 410 returns to the non-actuated state, the controller communicates with the stepper motor 550 to drive the sliding member 505 in the reverse direction so that sliding member 505 is translated towards the home position 505A. In one example embodiment, the stepper motor 550 commences operation in the reverse direction after the trailing edge TE of the media sheet has advanced about 10 mm from the sensor 410. Upon detection of the second end 544 of the sliding member 505 at the home position 505A, the controller instructs the stepper motor 550 to stop. The operation of the aligning system 500 repeats for every media sheet passing through the media path 120. In an example embodiment, the alignment system 500 may allow for about a 50.8 mm interpage gap between consecutive media sheets.

The foregoing description of several embodiments has been presented for purposes of illustration. It is not intended to be exhaustive or to limit the invention to the precise designs disclosed, and obviously many modifications and variations may be carried out in other specific ways than those herein set forth without departing from the scope and essential characteristics of the invention. It is intended that the scope of the invention be defined by the claims appended hereto.

What is claimed is:

1. A media conveying system for aligning a media sheet in a media path of an apparatus, comprising:

a reference edge positioned along a side of the media path, the media path having a starting location and an ending location, the media sheet moves in the media path in a media feed direction;

a first roll mounted across the media path;

a second roll mounted relative to the first roll so as to define a first nip between the first roll and the second roll, one of the first and second rolls being a rotationally driven roll;

a drive mechanism coupled to both the first and second rolls for translating the first and second rolls in a first direction other than the media feed direction such that the media sheet positioned in the first nip moves in the first direction towards the reference edge, the drive mechanism comprising:

a motor operable in forward and reverse directions; and a bracket for mounting the first and second rolls, the bracket comprising a rack gear portion for receiving rotary power from the motor;

at least one sensing device for detecting a location of the media sheet in the media path; and a controller communicatively coupled to the at least one sensing device and the drive mechanism for controlling a translation of the first and second rolls based upon the detected location of the media sheet, wherein rotational movement of the motor causes movement of the bracket in the first direction towards the reference edge, and wherein the at least one sensing device detects a location of a leading edge of the media sheet in the media path, and the controller receives data from the at least one sensing device such that following a positive detection and following the leading edge of the media sheet moving a predetermined distance from the at least one sensing device in the media feed direction, the controller controls the drive mechanism to translate the second roll a first distance in the first direction from a home position towards the reference edge.

2. The system of claim 1, further comprising:

a third roll mounted across the media path; and a fourth roll mounted relative to the third roll so as to define a second nip between the third and the fourth rolls, one of the third and fourth rolls being a driven roll of the second nip, the driven roll of the second nip rotates together with the driven roll of the first nip;

wherein the second nip is positioned laterally adjacent to the first nip.

3. The system of claim 1, wherein the controller further receives data from the at least one sensing device detecting a location of a trailing edge of the media sheet in the media path, and following a positive detection of the location of the trailing edge of the media sheet by the at least one sensing device, the controller controls the drive mechanism to translate the second roll a second distance in a second direction away from the reference edge and towards the home position, and wherein the first distance is substantially equal to the second distance.

4. The system of claim 3, wherein following a positive detection of the location of the trailing edge of the media sheet and following the trailing edge of the media sheet moving a second predetermined distance from the at least one sensing device, the controller controls the drive mechanism to translate the second roll the second distance towards the home position.

5. The system of claim 4, wherein the second predetermined distance is about 40 mm.

6. The system of claim 1, further comprising a second sensing device communicatively coupled to the controller and positioned adjacent to the reference edge for detecting a location of a lateral edge of the media sheet, and upon a positive detection of the location of the lateral edge of the media sheet, the controller controls the drive mechanism to stop movement of the second roll toward the reference edge.

7. The system of claim 1, wherein the second roll has a length shorter than the first roll.

8. The system of claim 1, wherein the apparatus includes a finishing device positioned further downstream along the media path for performing a finishing operation.

9. The system of claim 8, wherein the finishing device is a hole puncher.

10. The system of claim 1, wherein the predetermined distance is between about 65 mm and about 70 mm.

11. A system to align a media sheet in a media path of an apparatus comprising:

a media path having a starting location and an ending location, wherein media moves in the media path in a media feed direction;

a reference edge positioned along a side of the media path;

a first roll mounted across the media path;

a second roll mounted relative to the first roll so as to define a first nip between the first roll and the second roll, one of the first and second rolls being a driven roll; and a drive mechanism coupled to only the other of the first and second rolls which is not the driven roll for translating the other of the first and second rolls, the other of the first and second rolls being translated only in a first direction other than the media feed direction after the media sheet enters the first nip such that the media sheet positioned in the first nip moves in the first direction towards the reference edge, the drive mechanism comprising:

a motor operable in forward and reverse directions; and a bracket for mounting the other of the first and second rolls, comprising a rack gear portion receiving rotary power from the motor;

at least one sensing device for detecting a location of the media sheet in the media path; and a controller communicatively coupled to the at least one sensing device and the drive mechanism, for controlling a translation of the drive mechanism such that the drive mechanism translates the other of the first and second rolls mounted on the bracket based upon the detected location of the media sheet, wherein rotational movement of the motor causes movement of the bracket in the first direction, and wherein the at least one sensing device detects a location of a leading edge of the media sheet in the media path, and following a positive detection of the location of the leading edge of the media sheet and the leading edge of the media sheet moving a predetermined distance from the at least one sensing device in the media feed direction, the controller controls the drive mechanism to translate the other of the first roll and the second roll a first distance in the first direction from a home position towards the reference edge.

12. The system of claim 11, wherein the second roll has a length shorter than the first roll.

13. The system of claim 11, further comprising:

a third roll mounted across the media path; and a fourth roll mounted relative to the third roll so as to define a second nip between the third and the fourth rolls, one of the third and fourth rolls being a driven roll of the second nip, the driven roll of the second nip rotates together with the driven roll of the first nip;

wherein the second nip is positioned laterally adjacent to the first nip.

14. The system of claim 11, wherein the at least one sensing device detects a location of a trailing edge of the media sheet in the media path, and following a positive detection of the location of the trailing edge of the media sheet, the controller controls the drive mechanism to translate the other of the first roll and the second roll a second distance in a second direction away from the reference edge and towards the home position, and wherein the first distance is substantially equal to the second distance.

15. The system of claim 11, further comprising a sensing device positioned adjacent to the reference edge for detecting a location of a lateral edge of the media sheet, and a controller communicatively coupled to the drive mechanism and the sensing device, and upon a positive detection, controlling the drive mechanism to stop the translation of the other of the first roll and the second roll toward the reference edge.

16. The system of claim 11, wherein the apparatus includes a finishing device positioned further downstream along the media path for performing a finishing operation.

17. The system of claim 16, wherein the finishing device is a hole puncher.

18. The system of claim 11, wherein the controller further receives data from the at least one sensing device detecting a location of a leading edge of the media sheet in the media path, and upon a positive detection and when the leading edge of the media sheet moves a predetermined distance from the at least one sensing device in the media feed direction, the controller controls the drive mechanism to translate the other of the first roll and the second roll a first distance in the first direction from the home position towards the reference edge.

19. A system to align a media sheet in a media path of an apparatus, comprising:

a media path having a starting location and an ending location, wherein media moves in the media path in a media feed direction;

a reference edge positioned along a side of the media path;

a first roll mounted across the media path;

a second roll mounted relative to the first roll so as to define a first nip between the first roll and the second roll, one of the first and second rolls being a driven roll; and a drive mechanism coupled to only the other of the first and second rolls which is not the driven roll for translating the other of the first and second rolls, the other of the first and second rolls being translated only in a first direction other than the media feed direction after the media sheet enters the first nip such that the media sheet positioned in the first nip moves in the first direction towards the reference edge, the drive mechanism comprising:

a motor operable in forward and reverse directions; and a bracket for mounting the other of the first and second rolls, comprising a rack gear portion receiving rotary power from the motor;

at least one sensing device for detecting a location of the media sheet in the media path; and a controller communicatively coupled to the at least one sensing device and the drive mechanism, for controlling a translation of the drive mechanism such that the drive mechanism translates the other of the first and second rolls mounted on the bracket based upon the detected location of the media sheet, wherein rotational movement of the motor causes movement of the bracket in the first direction, and wherein the controller further receives data from the at least one sensing device detecting a location of a leading edge of the media sheet in the media path, and upon a positive detection and when the leading edge of the media sheet moves a predetermined distance from the at least one sensing device in the media feed direction, the controller controls the drive mechanism to translate the other of the first roll and the second roll a first distance in the first direction from a home position towards the reference edge.

* * * * *